US010393344B2

(12) United States Patent
Gibbs et al.

(10) Patent No.: US 10,393,344 B2
(45) Date of Patent: Aug. 27, 2019

(54) UPLIGHT REFLECTOR FOR LUMINAIRES

(71) Applicants: Anthony Ryan Gibbs, Atlanta, GA (US); Christopher Michael Bryant, Social Circle, GA (US)

(72) Inventors: Anthony Ryan Gibbs, Atlanta, GA (US); Christopher Michael Bryant, Social Circle, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/141,481

(22) Filed: Apr. 28, 2016

(65) Prior Publication Data

US 2016/0320019 A1 Nov. 3, 2016

Related U.S. Application Data

(60) Provisional application No. 62/155,816, filed on May 1, 2015.

(51) Int. Cl.

| | |
|---|---|
| ***F21V 7/04*** | (2006.01) |
| ***F21V 7/00*** | (2006.01) |
| ***F21V 29/77*** | (2015.01) |
| ***F21V 29/83*** | (2015.01) |
| *F21Y 101/00* | (2016.01) |

(52) U.S. Cl.

CPC ..... *F21V 7/0008* (2013.01); *F21V 7/04* (2013.01); *F21V 29/77* (2015.01); *F21V 29/83* (2015.01); *F21Y 2101/00* (2013.01)

(58) Field of Classification Search

CPC ..... F21V 7/00; F21V 7/0008; F21V 7/04–09; F21V 29/50; F21V 29/70; F21V 29/71; F21V 29/713; F21V 29/77; F21V 29/773; F21V 29/777; F21V 29/83

USPC ..... 362/249.02, 235, 236, 294, 373

See application file for complete search history.

(56) References Cited

U.S. PATENT DOCUMENTS

| | | | | |
|---|---|---|---|---|
| 4,903,180 | A | 2/1990 | Taylor et al. | |
| 6,575,601 | B1 | 10/2003 | Sitzema, Jr. et al. | |
| 8,573,806 | B1 * | 11/2013 | Moon | F21V 7/06 362/249.02 |
| 2008/0204888 | A1 * | 8/2008 | Kan | F21S 8/026 359/629 |

(Continued)

OTHER PUBLICATIONS

International Search Report for PCT Patent Application No. PCT/US2016/09824 dated Aug. 11, 2016.

*Primary Examiner* — Sean P Gramling
*Assistant Examiner* — Keith G. Delahoussaye
(74) *Attorney, Agent, or Firm* — King & Spalding LLP

(57) ABSTRACT

A light fixture assembly includes a light fixture and one or more reflectors having a curved cross-sectional profile. The light fixture includes a housing that is configured to house one or more electrical components of the light fixture. Further, the light fixture includes a heat sink that is coupled to the housing, and a plurality of light sources coupled to a bottom surface of the heat sink such that they emit light in a first direction. At least one of the one or more reflectors is coupled to the heat sink and disposed in the first direction of at least a portion of the plurality LEDs such that the light emitted by the portion of the plurality of LEDs is reflected by a substantially concave shaped inner surface of the respective reflector towards a second direction that is substantially opposite to the first direction.

20 Claims, 11 Drawing Sheets

(56) References Cited

U.S. PATENT DOCUMENTS

| | | | | |
|---|---|---|---|---|
| 2011/0050100 | A1 | 3/2011 | Bailey et al. | |
| 2014/0199168 | A1* | 7/2014 | Spiro | F04D 29/582 416/5 |

* cited by examiner

UPLIGHT REFLECTOR FOR LUMINAIRES

CROSS REFERENCE TO RELATED APPLICATIONS

This non-provisional patent application claims priority under 35 U.S.C. § 119 to U.S. Provisional Patent Application No. 62/155,816, titled 'Uplight Reflector for Luminaires,' filed on May 1, 2015, which is hereby fully incorporated herein by reference.

TECHNICAL FIELD

Embodiments of the present disclosure relate generally to lighting reflectors, and more particularly to light reflectors for providing an amount of uplight from downward pointing luminaires.

BACKGROUND

Traditional ceiling mount light fixtures, such as those utilizing fluorescent or HID light sources, emit light downward but also provide an amount of sideways light or even uplight. Specifically, many of these light sources are packed in globe-like or curved refractors which provide distributed light emission. Recently, there has been a trend in lighting technology towards replacing such traditional light sources with light emitting diode (LED) light sources, largely due to the efficiency advantages of LEDs. However, LEDs are a directional light source, meaning they generally emit light in the direction in which they are aimed, which is different from traditional fluorescent, HID, or incandescent light sources. In many ceiling mounted LED light fixtures, all of the LEDs are aimed towards the ground, creating an absence of uplight. In certain application environments, such as in warehouses or other high ceiling structures, the absence of uplight creates an undesirable "cave effect", in which the ceiling and space above the light fixtures are dark. Thus, there remains a need for a technology that can provide uplight from downward pointing luminaires.

SUMMARY

In one aspect, the present disclosure can relate to a light fixture assembly. The light fixture assembly includes a housing that is configured to house one or more electrical components of the light fixture. Further, the light fixture assembly includes a heat sink that is coupled to the housing. Furthermore, the light fixture assembly includes a plurality of LEDs coupled to a surface of the heat sink such that they emit light in a first direction. The light fixture assembly also includes one or more reflectors. Each reflector has a substantially curved cross-sectional profile. Further, at least one of the one or more reflectors is coupled to the heat sink and disposed in the first direction of at least a portion of the plurality LEDs such that light emitted by the portion of the plurality of LEDs in the first direction is reflected by the at least one of the one or more reflectors towards a second direction that is substantially opposite to the first direction.

In another aspect, the present disclosure can relate to a light fixture assembly that has a light fixture. The light fixture includes a housing frame that defines a cavity. Further, the light fixture includes a back panel disposed on a top portion of the housing frame such that the back panel covers one side of the cavity and defines a top surface of the light fixture. Furthermore, the light fixture includes a plurality of light sources coupled to the back panel such that they emit light downwards. The light fixture also includes a first reflector having a substantially curved cross-sectional profile and coupled to the back panel adjacent a first end plate of the housing such that an inner surface of the first reflector having a substantially concave profile reflects light that is emitted downwards by at least a first portion of the plurality light sources adjacent the first end plate of the housing frame upwards. Additionally, the light fixture includes a second reflector having a substantially curved cross-sectional profile and coupled to the back panel adjacent a second end plate such that an inner surface of the second reflector having a substantially concave profile reflects light that is emitted downwards by at least a second portion of the plurality light sources adjacent a second end plate of the housing frame upwards. The remaining portion of the plurality of light sources emit light downwards.

These and other aspects, objects, features, and embodiments will be apparent from the following description and the appended claims.

BRIEF DESCRIPTION OF THE FIGURES

The foregoing and other features and aspects of the disclosure are best understood with reference to the following description of certain example embodiments, when read in conjunction with the accompanying drawings, wherein.

Figure 1:
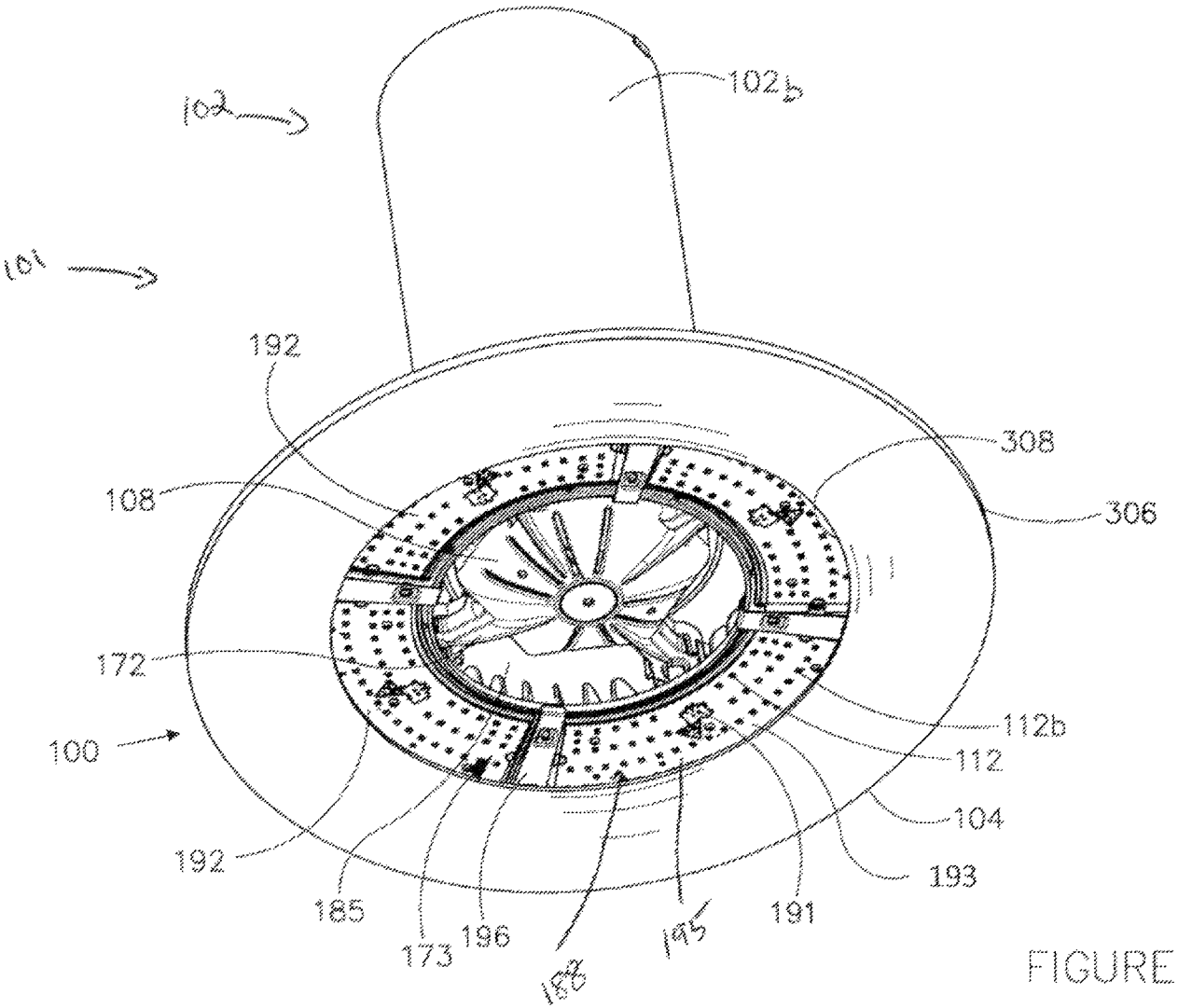
FIG. 1 illustrates a bottom perspective view of a light fixture assembly with an example uplight reflector, in accordance with example embodiments of the present disclosure.

The drawings illustrate only example embodiments and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to a light fixture having an example reflector that is configured to provide redirected illumination. In particular, the light fixture includes a plurality of light sources that are positioned to emit light in a first direction, e.g., towards an area to be illuminated, downwards, towards the floor, etc. The example reflector may be coupled to the light fixture such that light from a portion of the plurality of light fixtures that is normally going towards the first direction is reflected and redistributed by the reflector towards a second direction, e.g., a direction opposite to the first direction, upwards, towards the ceiling, etc., or sideways. The reflected and redistributed light may eliminate or reduce the undesirable "cave effect".

In certain embodiments, the example reflector may be coupled to the light fixture using a tool-less mounting mechanism, while in other embodiments, the example reflector may be coupled to the light fixture using a mechanical mounting mechanism. Further, in certain embodiments, the example reflector may be a single-piece reflector, such as a single spun revolved reflector, while in other embodiments, the example reflector may be a multi-piece reflector, such as a multiple injection molded reflectors. Furthermore, in addition to the reflective property, the example reflector may also have diffuser properties for a smooth distribution of the reflected light in the second direction. Alternatively, the example reflector may only have reflective properties.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Figure 2:
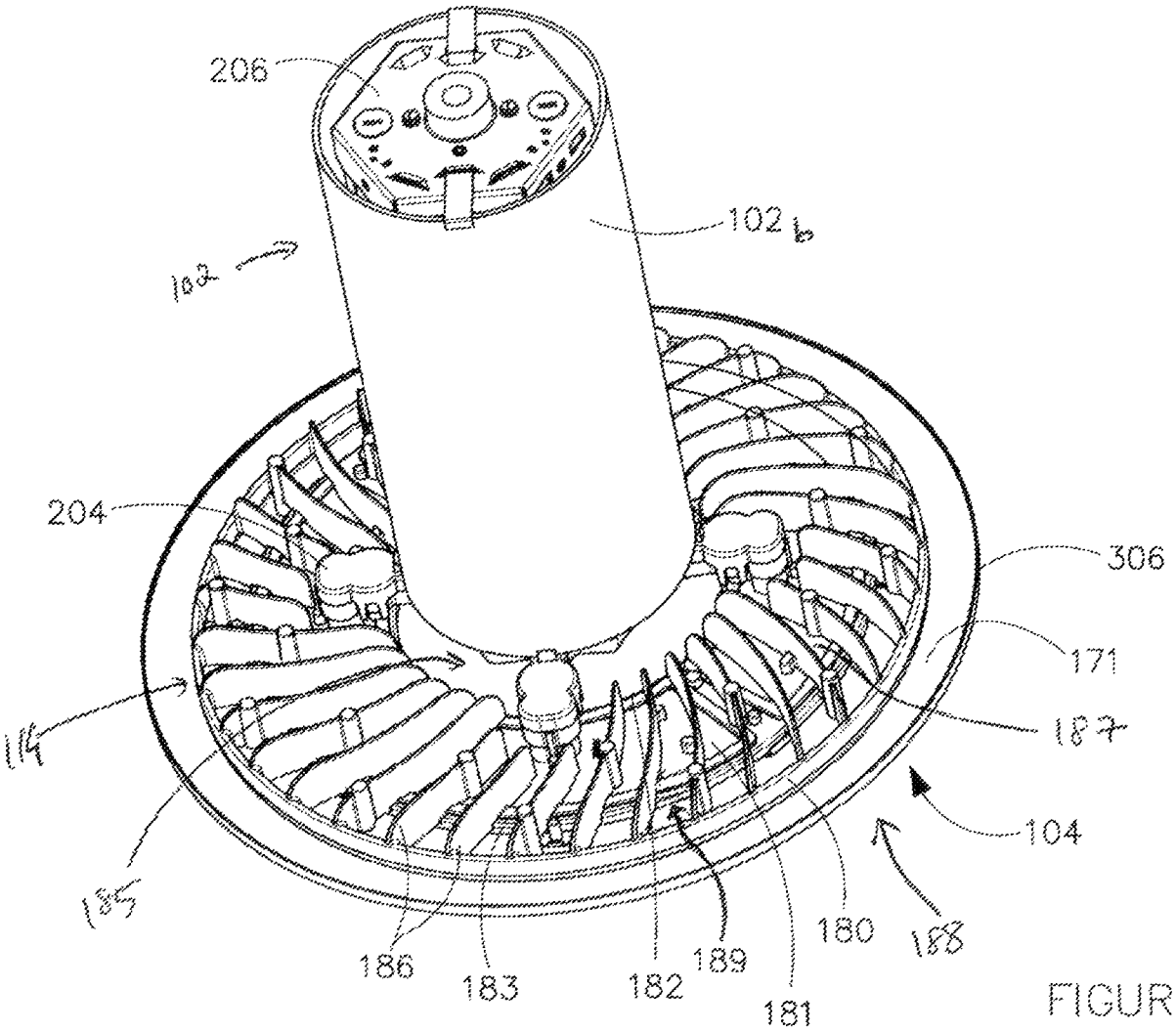
FIG. 2 illustrates a top perspective view of the light fixture assembly of FIG. 1 with the example uplight reflector, in accordance with example embodiments of the present disclosure.
Figure 3A:
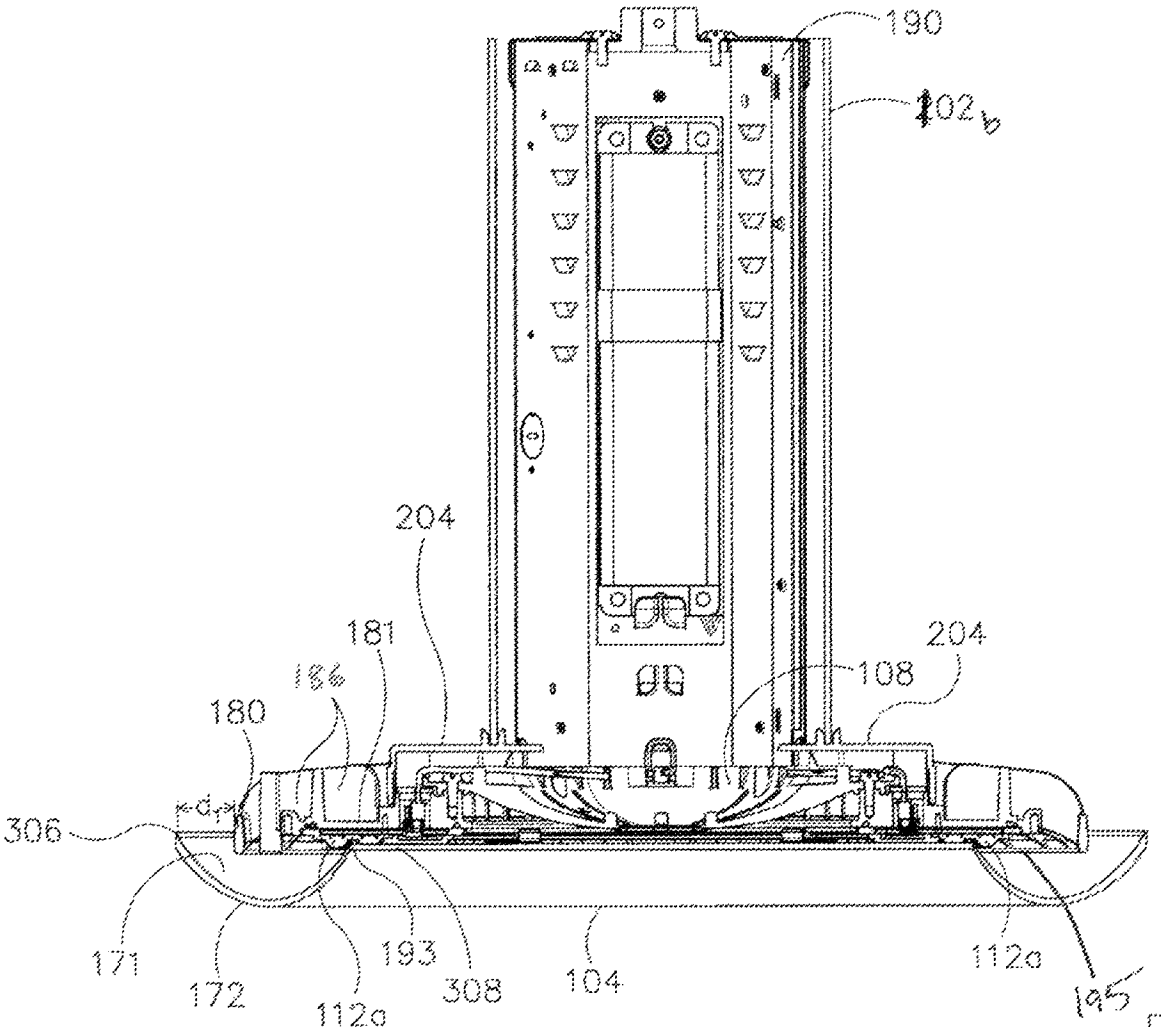
FIG. 3A illustrates a cross-sectional view of the light fixture assembly of FIG. 1 with the example uplight reflector, in accordance with example embodiments of the present disclosure.
Figure 3B:
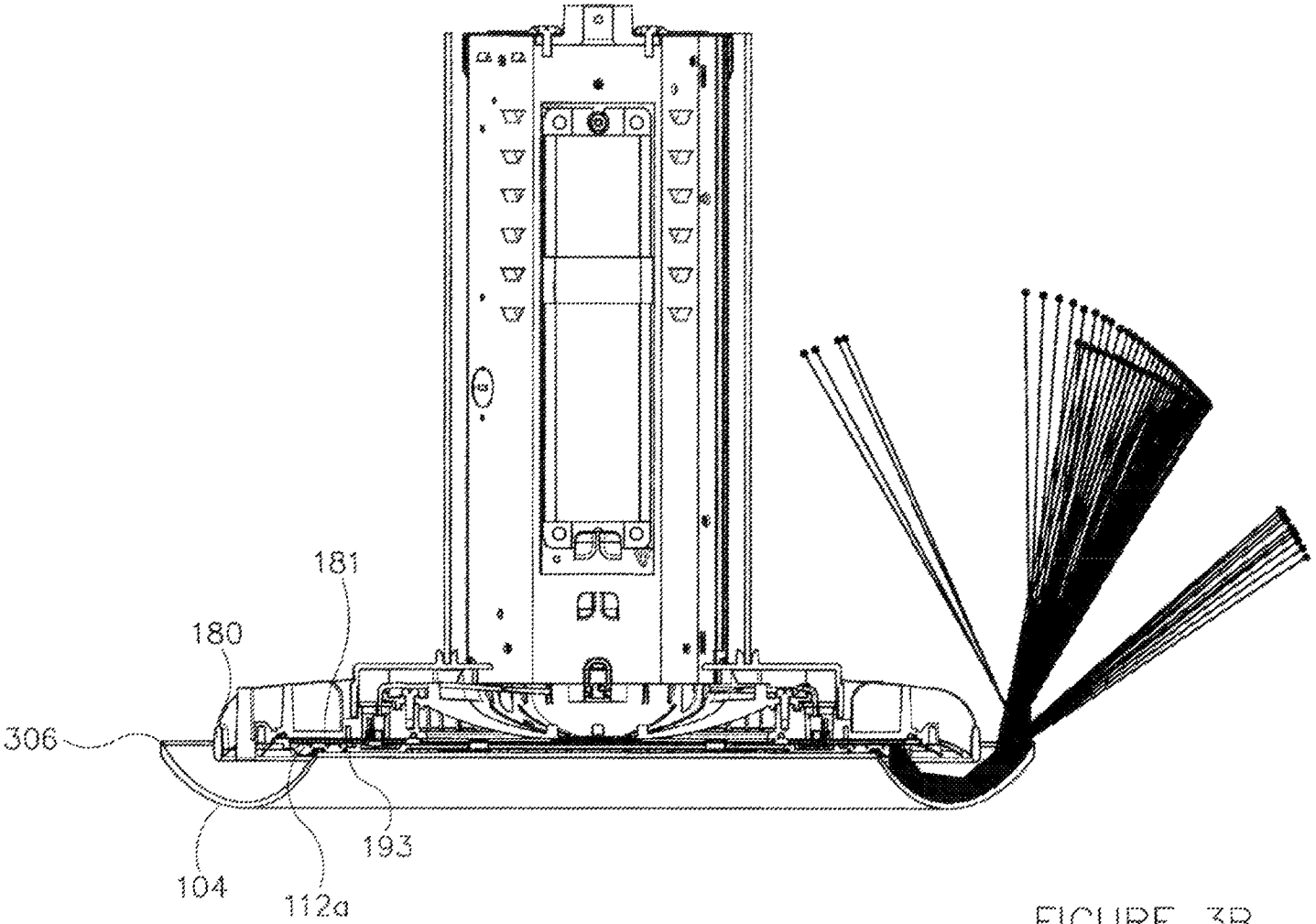
FIG. 3B illustrates a cross-sectional view of the light fixture assembly of FIG. 1 with ray tracing that shows an example reflection of light by the example uplight reflector to provide an uplight, in accordance with example embodiments of the present disclosure.

FIG. 1 illustrates a bottom perspective view of a light fixture assembly with an example uplight reflector, in accordance with example embodiments of the present disclosure; FIG. 2 illustrates a top perspective view of the light fixture assembly of FIG. 1 with the example uplight reflector, in accordance with example embodiments of the present disclosure; FIG. 3A illustrates a cross-sectional view of the light fixture assembly of FIG. 1 with the example uplight reflector, in accordance with example embodiments of the present disclosure; and FIG. 3B illustrates a cross-sectional view of the light fixture assembly of FIG. 1 with ray tracing that shows an example reflection of light by the example uplight reflector to provide an uplight, in accordance with example embodiments of the present disclosure. Hereinafter, FIGS. 3A and 3B may be collectively referred to as FIG. 3.

Figure 5:
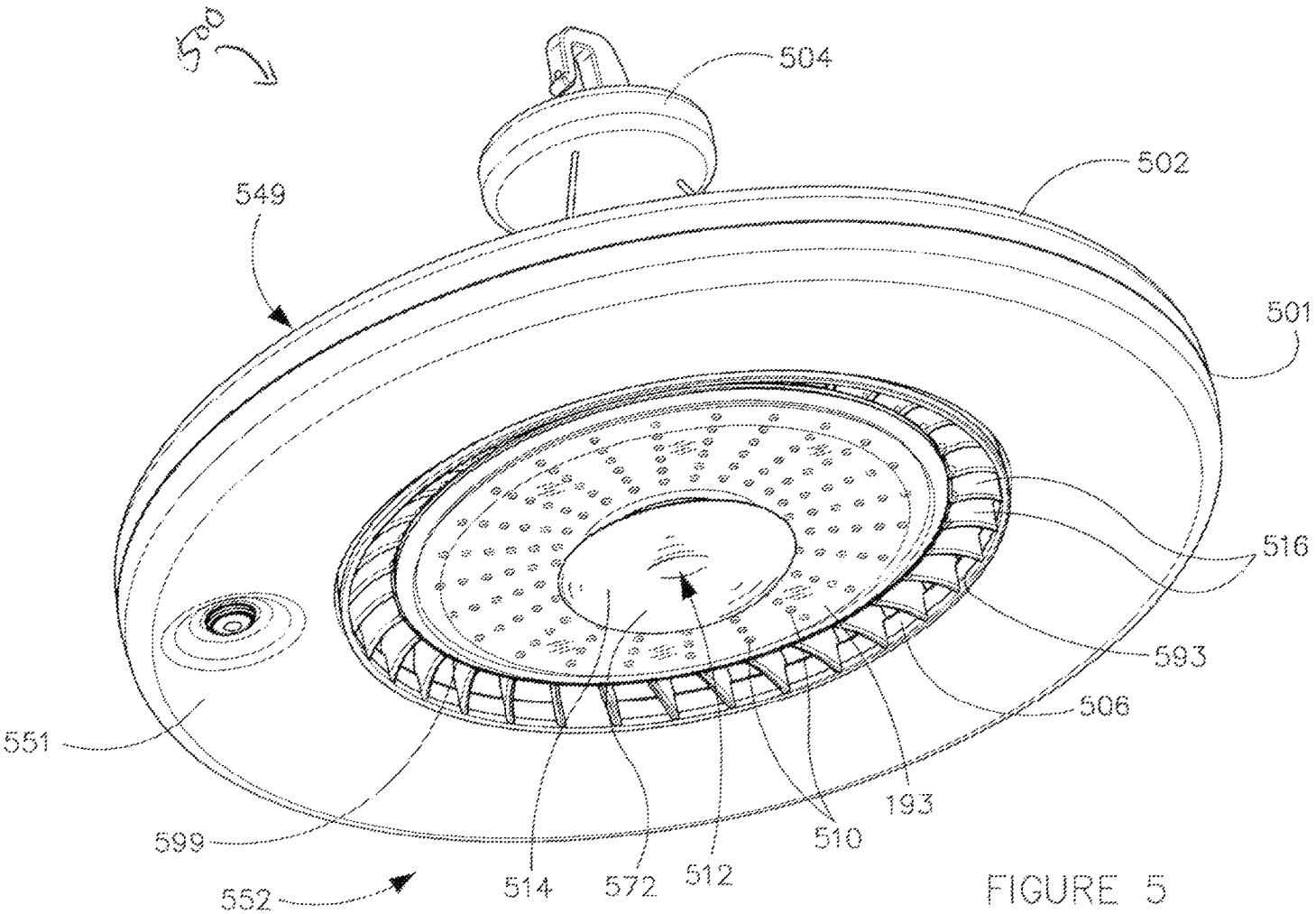
FIG. 5 illustrates a perspective view of another light fixture assembly with yet another uplight reflector, in accordance with example embodiments of the present disclosure.
Figure 6:
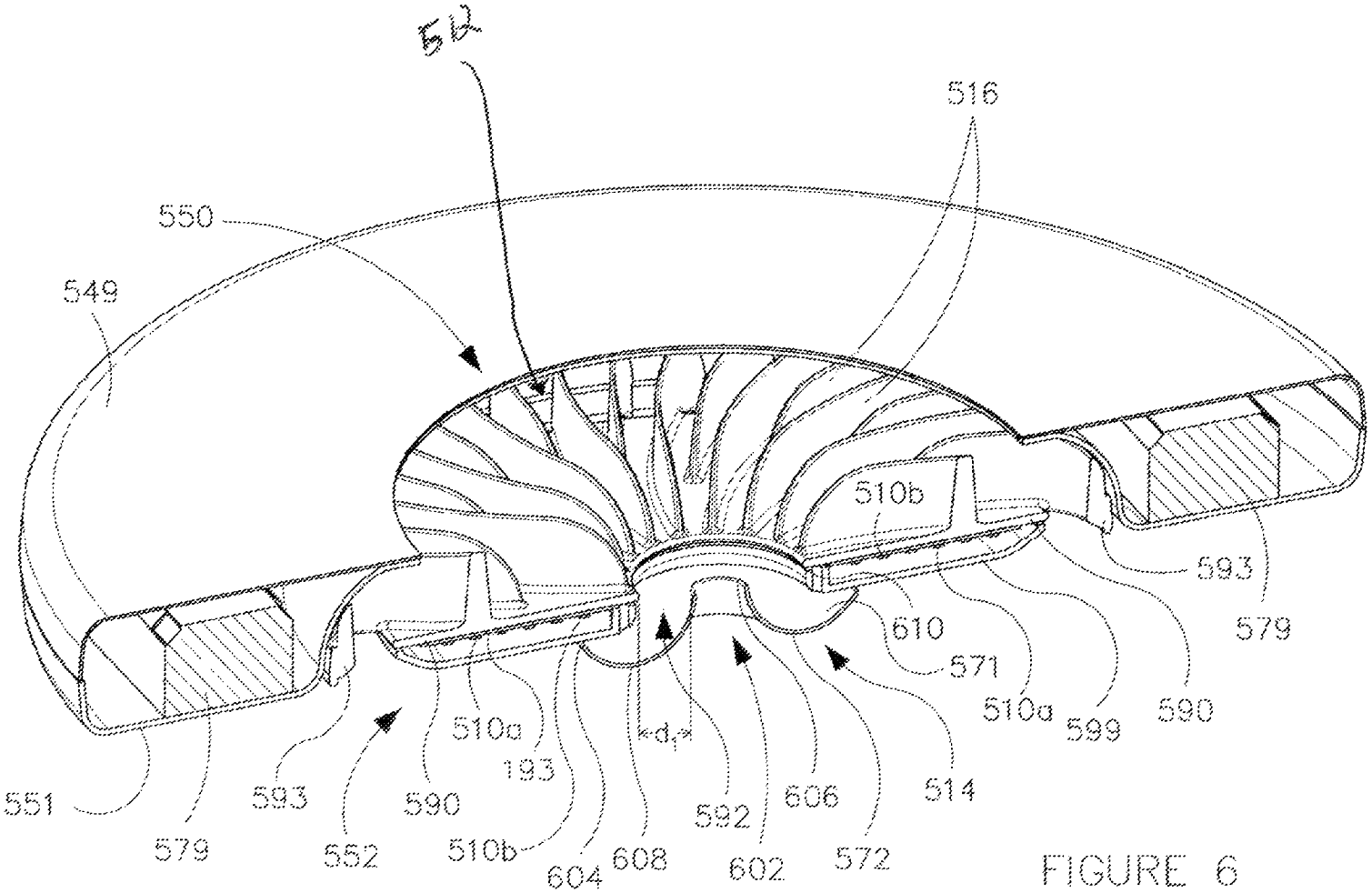
FIG. 6 illustrates a cross-sectional view of the light fixture assembly of FIG. 5 with the uplight reflector of FIG. 5, in accordance with example embodiments of the present disclosure.
Figure 7:
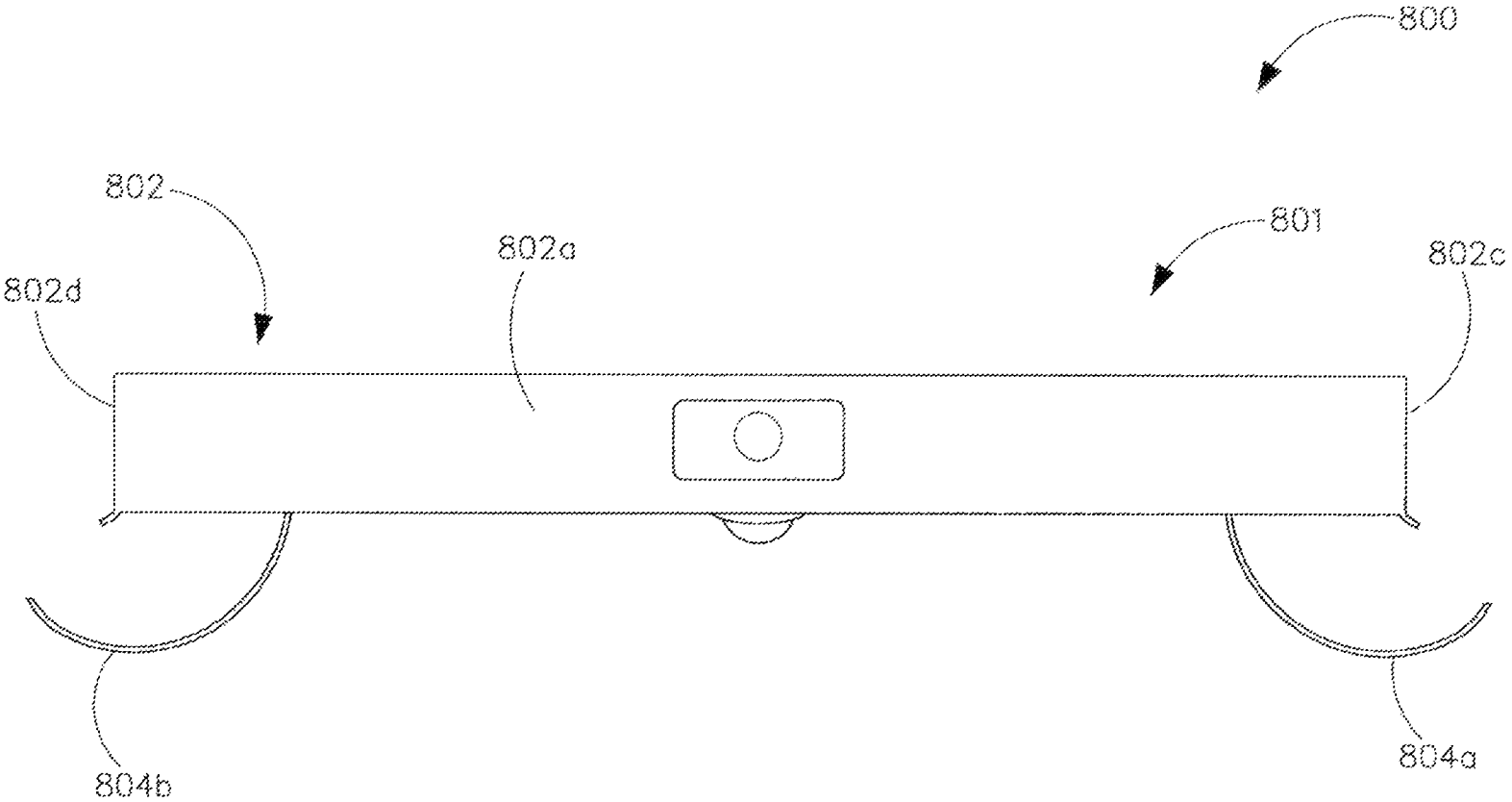
FIGS. 7-8 illustrate different views of yet another light fixture assembly with one or more uplight reflectors, in accordance with example embodiments of the present disclosure.
Figure 8:
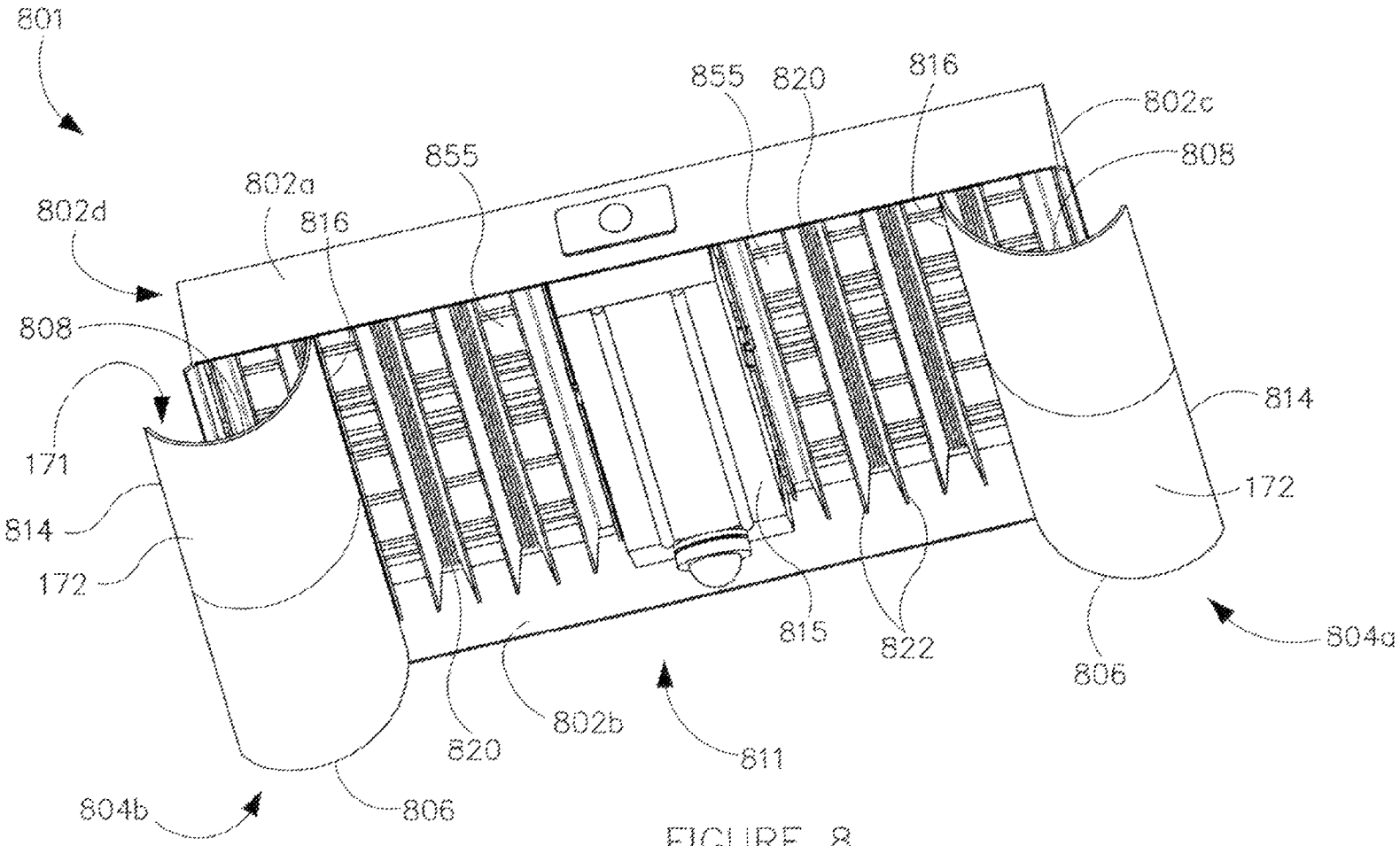
Figure 9:
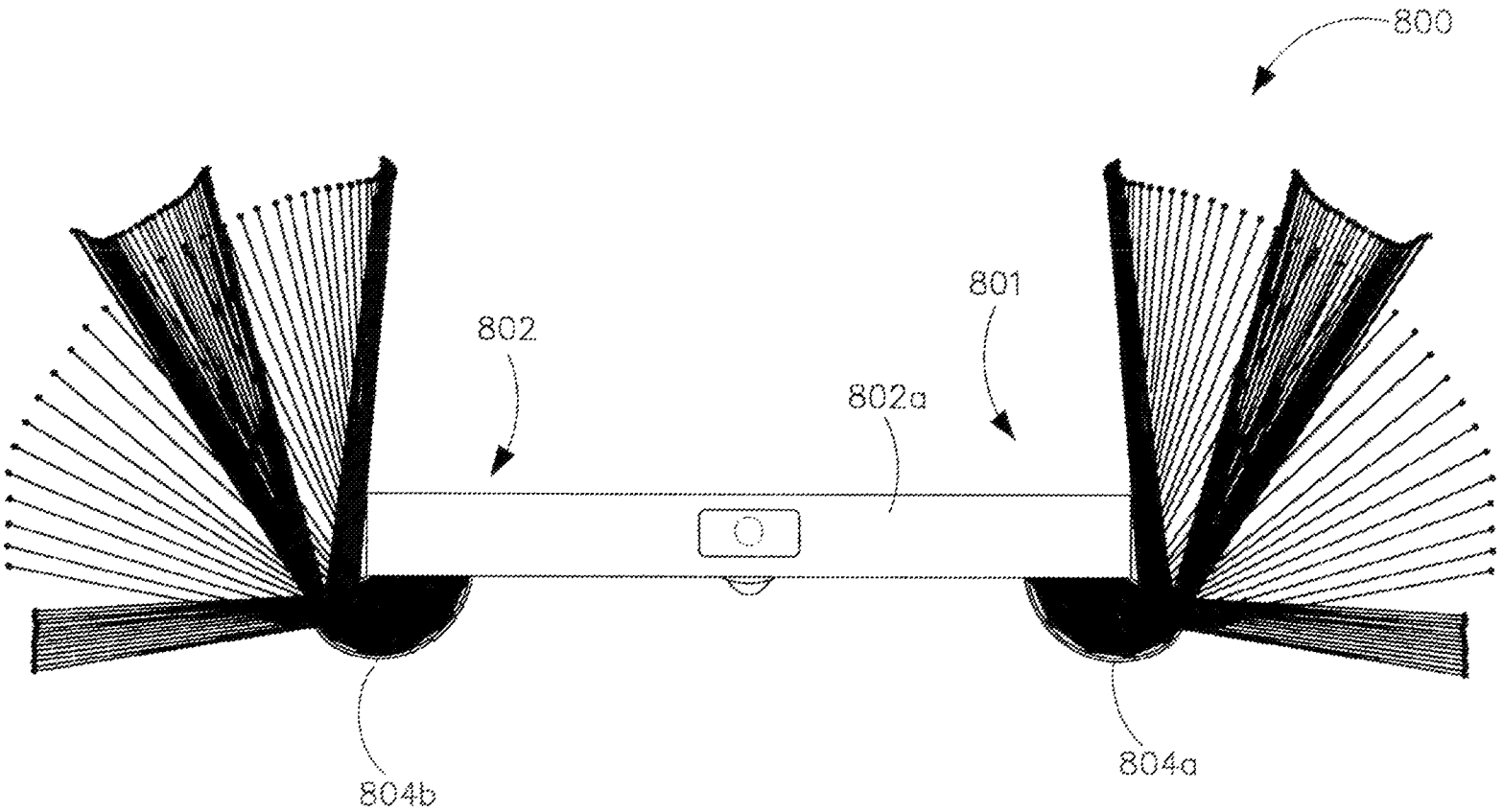
FIG. 9 illustrates the light fixture assembly of FIGS. 7-8 with ray tracing that shows an example reflection of light by the one or more reflectors to provide an uplight, in accordance with example embodiments of the present disclosure.

With reference to FIGS. 1, 2, and 3, the light fixture assembly 100 may include a light fixture 101 and a reflector 104. In particular, the light fixture 101 may include a housing 206 and a heat sink 114. As illustrated in the example embodiment of FIGS. 2-3, the housing 206 may define a cavity 190 that is configured to house one or more electronic components associated with the light fixture 101, such as an LED driver. In particular, the housing 206 may have a side wall having a hexagonal cross-sectional profile, a bottom end 108, and a top cover as illustrated in FIGS. 1-3. However, in other example embodiments, the housing 206 can have a side wall having any other appropriate geometric or non-geometric cross-sectional shape without departing from a broader scope of the present disclosure. That is, even though the example embodiment of FIGS. 1-3 illustrates a cylindrical housing that has a hexagonal cross-sectional profile, one of ordinary skill in the art can understand and appreciate that in other embodiments, the housing can have any other geometric or non-geometric shape and can define a cavity of any appropriate shape without departing from a broader scope of the present disclosure. For example, the housing 206 can have a substantially doughnut shaped profile as illustrated in FIGS. 5-6, or the housing can have a substantially rectangular shaped profile as illustrated in FIGS. 7-9.

Further, as illustrated in FIGS. 1-3, the light fixture 101 may include an optional thermal barrier 102 that has a substantially cylindrical side wall 102*b* (herein 'housing wall 102*b*'). The optional thermal barrier 102 may be disposed outside and around the housing 206 to thermally insulate the housing 206 carrying the electronic components from the heat dissipated by the heat sink 114.

In certain example embodiments, as illustrated in FIGS. 1-3, the heat sink 114 of the light fixture assembly 100 may include an annular outer plate 180 and a generally planar base portion 181 that has a substantially circular/disc-like shape. In particular, the planar base portion 181 may include a substantially circular central orifice 185 defined by an inner annular edge 182 of the planar base portion 181. Further, the planar base portion 181 may include an outer annular edge 183 that is larger in diameter than the inner annular edge 182 and concentric with the inner annular edge 182. Furthermore, the planar base portion 181 may include a top surface 187 and a bottom surface 188 (covered by circuit board and LEDs) facing a direction that is opposite to the top surface 187. The top and bottom surfaces (187, 188) of the planar base portion 181 may extend between or may be confined by an inner annular edge 182 and an outer annular edge 183.

As illustrated in FIGS. 2 and 3, the annular outer plate 180 of the heat sink 114 may be disposed around the planar base portion 181 and may have a diameter that is larger than that of the outer annular edge 183 of the planar base portion 181. Accordingly, there may be a substantially ring shaped gap between the annular outer plate 180 and the outer annular edge 183 of the planar base portion 181, where the ring shaped gap is larger in diameter and concentric with the central orifice 185. Further, the planar base portion 181 may include a plurality of apertures 191 that extend from the top surface 187 through the bottom surface 188 of the planar base portion 181. The through apertures 191 may provide a passageway for electrical wires from the electronic components disposed in the cavity 190 of the housing 206 to the LEDs/LED panels (112 and/or 192) secured to the bottom surface 188 (underside) of the planar base portion 181.

In addition to the planar base portion 181 and the outer annular plate 180, the heat sink 114 may include a plurality of fins 186 that: (a) extend substantially perpendicularly to the top surface 187 of planar base portion 181, and (b) extend from the annular outer plate 180 towards the inner annular edge 182 of the planar base portion 181. In particular, the fins 186 may transfer heat away from one or more LEDs/LED panels (112 and/or 192) that are disposed on and secured to the bottom surface 188 (underside) of the planar base portion 181.

Furthermore, the heat sink 114 may include air flow openings 189 that define ambient air flow passageways in a direction generally perpendicular to the plane of the heat sink 114 (e.g., substantially vertical air flow passageways when the heat sink 114 is installed in a generally horizontal manner). In particular, the air flow openings 189 may be formed within the ring shaped gap between the annular outer plate 180 and the outer annular edge 183. As illustrated in FIG. 2, each air flow opening 189 may have an enclosed perimeter that is defined by the outer annular edge 183 of the planar base portion 181, a pair of fins 186, and the annular outer plate 180. The air flow openings 189 may provide increased heat transfer from the heat sink 114 and also a passageway for the reflected light to exit the light fixture assembly 100 (uplight).

In certain example embodiments, the heat sink 114 may be coupled to the housing 206 via a plurality of coupling arms 204 such that the bottom end 108 of the housing 206 may be disposed adjacent to and above the central orifice 185 of the heat sink 114. In certain example embodiments, the coupling arms 204 may extend outwardly from the bottom end 108 of the housing 206 and couple to the heat sink 114 via the inner annular edge 182 of the heat sink 114. However, one of ordinary skill in the art can understand and appreciate that in other example embodiments, the coupling arms 204 may couple to the heat sink 114 at any other portion of the heat sink 114 and/or any other appropriate coupling mechanism may be used to couple the heat sink 114 to the housing 206 without departing from a broader scope of the present disclosure. Further, in other example embodiments, the heat sink 104 and the housing 206 may be integral to each other without departing from a broader scope of the present disclosure. Furthermore, even though the present disclosure describes the heat sink 104 as having various parts, one of ordinary skill in the art can understand and appreciate that the heat sink 114 is a single integral component.

As illustrated in FIGS. 1 and 3, the light fixture assembly 100 may further include an LED panel 192 that is coupled to or mounted on the bottom surface 188 of the heat sink's planar base portion 181. In particular, the LED panel 192 may include a circuit board 193 that is mounted on the bottom surface 188 using any appropriate coupling mechanism, such as fasteners, adhesives, etc. The circuit board 193 may have a shape that is substantially similar to that of the planar base portion 181 of the heat sink 114. That is, the circuit board 193 may be a substantially disc-shaped board with a central orifice that aligns with the central orifice 185 of the heat sink 114. Further, the LED panel 192 may include a plurality of LEDs 112 that are disposed on the circuit board 193 in a concentric ring configuration and facing a first direction such that they emit light in a first direction. For example, the plurality of LEDs 112 may be arranged to emit light downwards towards an area to be illuminated. Even though the present disclosure describes the plurality of LEDs 112 as being disposed in the shape of concentric rings on the circuit board 193, one of ordinary skill in the art can understand and appreciate that in other example embodiments, the plurality of LEDs 112 may be disposed in any other appropriate geometric or non-geometric configuration without departing from a broader scope of the present disclosure.

Furthermore, as illustrated in FIGS. 1 and 3, the light fixture assembly 100 may include one or more over-optics 195 that are disposed over the LEDs 112. As illustrated in FIG. 1, each over optic 195 may be coupled to the heat sink 114 or the circuit board 193 using a pair of brackets 196 on either sides of the over optic 195 such that they cover a group of LEDs 112. In combination, the one or more over-optics 195 may cover all the LEDs of the plurality of LEDs 112 as illustrated in FIG. 1. Even though FIG. 1 illustrates four over-optic panels 195 that divide the plurality of LEDs into four different groups of LEDs, one of ordinary skill in the art can understand and appreciate that in other embodiments, the number of over-optic panels 195 may be lesser or more without departing from a broader scope of the present disclosure.

Additionally, as illustrated in FIGS. 1-3, the light fixture 101 may include a reflector 104 that is disposed on or near the planar base portion 181 of the heat sink 114. In certain example embodiments, the reflector 104 may be ring shaped member with a substantially C-shaped or U-shaped cross-sectional profile. In other words, the reflector 104 may have an inner surface 171 that has a substantially concave profile and an outer surface 172 that is opposite to the inner surface 171 and has a substantially convex profile. Further, the boundaries of the reflector 104 (or alternatively, the boundaries of the inner and outer surfaces (171, 172)) may be defined by an inner annular edge 308 and an outer annular edge 306 that is concentric with and larger in diameter than the inner annular edge 308. In other words, the reflector 171 may have a curved body that extends between the inner annular edge 308 and an outer annular edge 306. Further, the inner annular edge 308 of the reflector 104 may define a substantially circular central opening 173 that is larger in diameter than the central orifice 185 of the heat sink 114. That is, the diameter of the inner annular edge 308 of the reflector 104 may be larger than the diameter of the inner annular edge 182 of the heat sink's planar base portion 181. Furthermore, the diameter of the outer annular edge 306 of the reflector 104 may be larger than the diameter of the annular outer plate 180 of the heat sink 114. Even though FIGS. 1-3, illustrate a specific shape of the reflector, one of ordinary skill in the art can understand and appreciate that in other embodiments, the reflector may have any other appropriate shape or dimensions that allows the reflector to reflect and redirect light going in a first direction to a second direction that is different from the first direction without departing from a broader scope of the present disclosure. For example, the reflector may be smaller in dimension as illustrated in FIGS. 5-6 or the reflector may not be ring shaped as in FIGS. 4 and 7-9.

In certain example embodiments, as illustrated in FIGS. 1-3, the reflector 104 may be coupled to the heat sink 114 such that: (i) the outer annular edge 306 of the reflector 104 is concentric with, remains outside, and is separated by a distance 'd1' from the annular outer plate 180 of the heat sink 114, and (ii) the concave inner surface 171 of the reflector 104 is disposed over a portion of the LEDs, e.g., an outermost ring of LEDs 112*a* on the circuit board 193 such that light emitted by the outermost ring of LEDs 112*a* is reflected by the inner surface 171 of the reflector 104 to a second direction through the air flow openings 189 and/or the space between the annular outer plate 180 and the outer annular edge 306 of the reflector 104, providing an uplight, as illustrated in FIG. 3B. Further, a remaining portion of the LEDs 112*b* fall within the central opening 173 defined by the inner annular edge 308 of the reflector 104 and are not covered by the reflector 104. Accordingly, light emitted by the remaining portion of LEDs 112*b* is unobstructed and directed in the first direction, providing light downwards or in an area to be illuminated. Thus, via the reflector 104, the light fixture 101 is capable of providing both downlight and uplight without using additional LEDs or changing the configuration of the LEDs.

In particular, the reflector 104 may be coupled to the heat sink 114 using tab features 174 (shown in FIG. 4B) of the reflector 104 that engages with the outer annular edge 183 of the heat sinks' planar base portion 181 and/or the annular outer plate 180. The tab features 174 may be configured to couple the reflector 104 to the heat sink 114 such that the outer annular edge 306 and/or the inner annular edge 308 of the reflector 104 may be detached from (i.e., not in direct contact with) the heat sink 114 or any other portion of the light fixture 101. In certain example embodiments, the tab features 174 of the reflector 104 may be integral with and extend vertically upwards (opposite direction of the outer surface 172) from the inner concave surface 171 of the reflector 104. That is, each tab feature 174 may include a first end that is attached to the reflector 104 and a second opposite end that includes an angled tab that is configured to engage with the outer annular edge 183 of the heat sinks' planar base portion 181 and/or the annular outer plate 180 of the heat sink 114. Further, the reflector 104 may include additional coupling features, such as screw bosses 177 as illustrated in FIG. 4B. Even though FIG. 4B illustrates a reflector having both the screw bosses 177 and the tab features 174, one of ordinary skill in the art can understand and appreciate that in other example embodiments, the reflector may have fewer or more coupling features without departing from a broader scope of the present disclosure. For example, in some embodiments, the reflector may not include the screw bosses 177. Further, one of ordinary skill in the art can understand and appreciate that, in other example embodiments, any other appropriate coupling mechanism may be used without departing from a broader scope of the disclosure. For example, the reflectors 104 may be coupled to the heat sink 114 and/or to any other portion of the light fixture 101 using fasteners, such as screws, rivets, clamps, clips, suspensions cables (strings), etc. Additionally, in other example embodiments, the reflector may be coupled to the light fixture such that the outer annular edge 306 and/or the inner annular edge 308 of the reflector 104 may be in direct contact with the heat sink, circuit board, or any other portion of the light fixture 101.

Even though FIGS. 1-3 illustrate a single piece reflector, such as a single spun revolved reflector, one of ordinary skill in the art can understand and appreciate that in other example embodiments, a multi-piece reflector may be used without departing from a broader scope of the present disclosure. For example, the multi-piece reflector may include a plurality of reflector segments that may be coupled to each other to form the shape of the single-piece reflector illustrated in FIGS. 1-3. Alternatively, the plurality of reflector segments that may be detached from each other and may be coupled to the heat sink 114 as illustrated in FIG. 4.

Figure 4A:
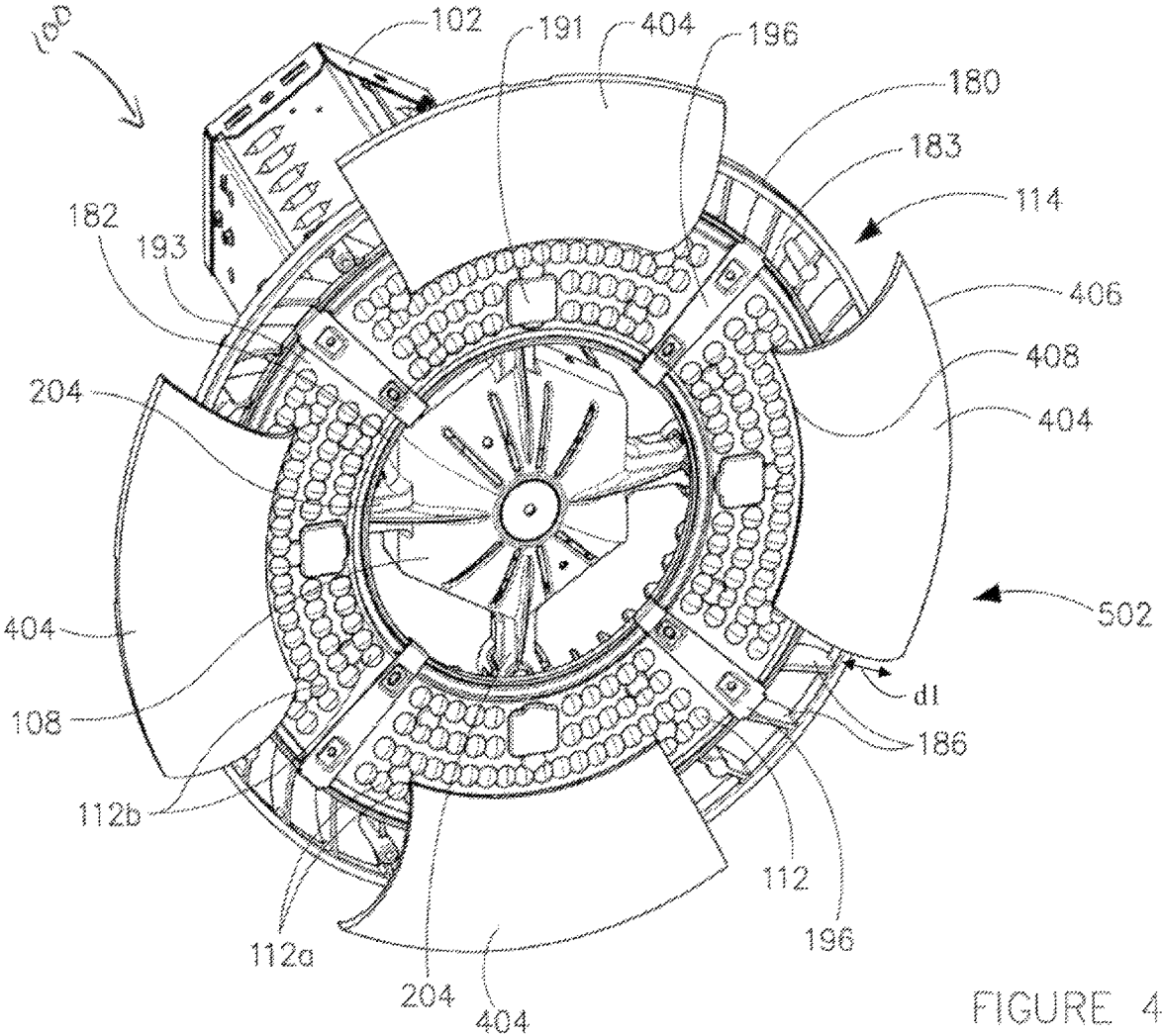
FIG. 4A illustrates a perspective view of the light fixture assembly of FIG. 1 with another example multi-piece uplight reflector, in accordance with example embodiments of the present disclosure.
Figure 4B:
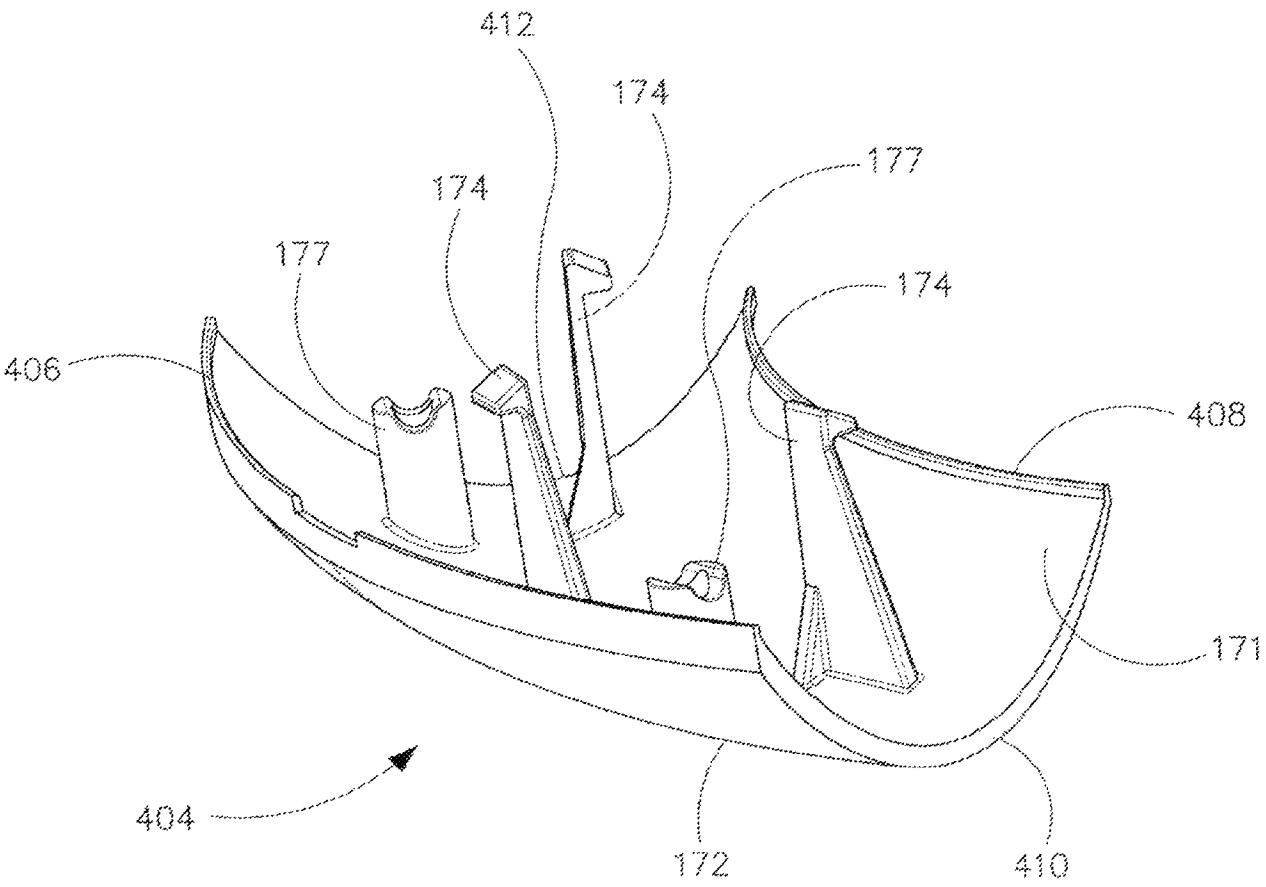
FIG. 4B illustrates a perspective view of one piece of the multi-piece reflector of FIG. 4A, in accordance with example embodiments of the present disclosure.

Turning to FIGS. 4A-4B, FIG. 4A illustrates a perspective view of the light fixture assembly of FIG. 1 with another example multi-piece uplight reflector, in accordance with example embodiments of the present disclosure; and FIG. 4B illustrates a perspective view of the multi-piece reflector of FIG. 4A, in accordance with example embodiments of the present disclosure. In particular, the light fixture assembly 100 of FIG. 4A may be substantially similar to the light fixture assembly 100 of FIGS. 1-3 except for the multi-piece reflector 402. Accordingly, for the sake of brevity, only the multi-piece reflector 402 will be described in greater detail. In certain example embodiments, the multi-piece reflector 402 may include a plurality of reflector segments 404 coupled to the heat sink 114 as described above in association with FIGS. 1 and 3. For example, as illustrated in FIG. 4B, each reflector segment 404 may include three tab features 174 and/or two screw bosses 177, two of the tab features 174 may couple the reflector segment 404 to the outer annular edge 183 of the heat sink's planar base portion 181, and one tab feature couples the reflector segment 404 to the annular outer plate 180. In particular, the reflector segments 404 may be coupled to the heat sink 114 via a tab feature 174 such that the reflector segments 404 may cover all or portions of the outermost layer of LEDs 112*a*.

As described above, the plurality of LEDs 112 may be divided into groups based on the number of over-optics used to cover the plurality of LEDs 112. For example, as illustrated in FIG. 4A, the plurality of LEDs 112 may be divided into four groups. In certain example embodiments, the reflector segments 404 may be coupled to the heat sink 114 such that each reflector segment 404 is disposed over each group of LEDs. For example, as illustrated in FIG. 4A, four reflector segments may cover one or more LEDs in each of the four groups of LEDs.

In certain example embodiments, each of the reflector segments 404 has an inner surface 171 having a concave profile and an outer surface 172 having a convex profile. Further, the inner and outer surfaces (171, 172) of each reflector segment 404 may be defined by a first longitudinal edge 406 (also interchangeably referred to as 'outer edge 406'), a second opposite longitudinal edge 408 (also interchangeably referred to as 'inner edge 408'), and a pair of lateral curved edges 410, 412. Furthermore, each reflector segment 404 may include tab features 174 as described above that engage with the heat sink 114 to couple the reflector segment 404 to the heat sink 114. In particular, as described above, the reflector segments 404 may be coupled to the heat sink 114 using the tab features 174 such that (i) the outer edge 406 of the reflector 104 remains outside the outer annular plate 180 and is separated by a distance 'd1' from the annular outer plate 180 of the heat sink 114, and (ii) the concave inner surface 171 of the reflector segment 404 is disposed below a portion of the LEDs, e.g., at least a portion of the outermost ring of a group of LEDs 112*a* such that light emitted by the portion of the outermost ring of the respective group of LEDs 112*a* (the ones covered by the reflector segments 404) is reflected towards a second direction through the space between the annular outer plate 180 and the first lateral edge 406 of the reflector segment 404, providing an uplight.

In certain example embodiments, the percentage of light emitted from the LEDs (for uplight) or the ratio of uplight to downlight can be changed by changing the size, the curvature, the number, and/or the placement of the reflector segments 404. The percentage of light emitted from the LEDs that is used for uplight can be determined by the percentage of LEDs that are covered by the reflector 402.

Even though the present disclosure describes a reflector segment per group of LEDs as illustrated in FIG. 4A, i.e., four reflector segments 404 for four groups of LEDs, one of ordinary skill in the art can understand and appreciate that in other embodiments, not all the group of LEDs may be covered by a reflector segment. For example, in some embodiments, even though there are four groups of LEDs as illustrated in FIG. 4A, reflector segments may be coupled to only three, two, or one group of LEDs without departing from a broader scope of the present disclosure. As another example, the reflector segments may only be disposed along one half side of the heat sink to provide uplight only in a specific direction above the light fixture and not annularly above the light fixture.

Further, even though the present disclosure describes the reflector 104/reflector segment 404 as being disposed over and covering an outermost ring of LEDs, one of ordinary skill in the art can understand and appreciate that in other embodiments, the reflector 104/reflector segments 404 may be coupled to any other portion of the light fixture 101 such that it may cover any other set of LEDs without departing from a broader scope of the disclosure provided. For example, as illustrated in FIGS. 5-6, the reflector or reflector segments may be coupled to the inner annular edge 182 of the heat sink 114 such that the reflector is disposed over and covers the innermost ring of LEDs 510*b*.

Turning to FIGS. 5-6, FIG. 5 illustrates a perspective view of another light fixture assembly with yet another uplight reflector, in accordance with example embodiments of the present disclosure; and FIG. 6 illustrates a cross-sectional view of the light fixture assembly of FIG. 5 with the uplight reflector of FIG. 5, in accordance with example embodiments of the present disclosure. In particular, the light fixture assembly 500 of FIGS. 5 and 6 may include a light fixture 501 and a reflector 514. The light fixture 501 may include a housing 502 that is configured to house one or more electronic components 579 (e.g., LED drivers, sensors, etc.) associated with the light fixture 501 and an attachment hook 504 coupled to the housing 502 for hanging or suspension mounting the light fixture 501 from a ceiling. Further, the light fixture 501 may include a heat sink 506 that is substantially similar to the heat sink 114 of FIGS. 1-4. For example, the heat sink 506 may include a planar base portion 590 that is substantially shaped like a disc and has a central circular aperture 592 (herein 'central aperture 592'), an annular outer plate 593 that is concentric with and disposed outside and around the planar base portion 590, and a plurality of heat sink fins 516 that extend from the annular outer plate 593 towards the central aperture 592 and is perpendicular to the planar base portion 590.

In particular, as illustrated in FIG. 5, the housing 502 may be substantially donut shaped with a top surface 549 having a central circular opening 550 and a bottom surface 551 having a central circular opening 552. Further, the housing 502 may have a central orifice/cavity 512 that extends from the central circular opening 550 of the top surface 549 to the central circular opening 552 of the bottom surface 551. The central circular opening 550 (herein 'central opening 550') on the top surface 549 of the housing 502 may have a smaller diameter than that of the central circular opening 552 (herein 'central opening 552') on the bottom surface 551 of the housing. Consequently, the size of the central orifice/cavity 512 gets wider from the central opening 550 of the top surface 549 towards the central opening 552 of the bottom surface 551.

Further, as illustrated in FIG. 6, the heat sink 514 may be coupled to the housing 502 such that (i) the heat sink 514 fits within the central orifice/cavity 512 of the housing 502 and (ii) the central aperture 592 of the heat sink 514 (smaller in diameter than the top central opening 550 and bottom central opening 552 of the housing 502) is coaxial with and lies in between the central opening 552 of the bottom surface 551 and the central opening 550 of the top surface 549. Furthermore, the light fixture assembly 500 may include a circuit board 193 that is disposed on and coupled to the bottom surface of the planar base portion of the heat sink 514, and the circuit board 193 may have a plurality of LEDs 510 disposed thereon. In certain example embodiments, the LEDs 510 may be arranged in a plurality of concentric rings on the PCB. However, in other example embodiments, any other configuration may be used to arrange the LEDs on the circuit board without departing from a broader scope of the present disclosure. Even though the present disclosure describes using LEDs, one of ordinary skill in the art can understand and appreciate that in other embodiments, the light fixture assemblies described herein may include any other appropriate point or non-point light sources instead of or in addition to the LEDs without departing from a broader scope of the present disclosure.

In certain example embodiments, the reflector 514 illustrated in FIGS. 5-6 may be substantially similar in shape, but different in dimension from the reflector 104 illustrated in FIGS. 1-4. In particular, the reflector 514 of FIGS. 5-6 may have a ring shaped body with a substantially C-shaped or U-shaped cross-sectional profile. The reflector 504 may have an inner surface 571 that has a substantially concave profile and an outer surface 572 that is opposite to the inner surface 571 and has a substantially convex profile. Further, the boundaries of the reflector 514 (or alternatively, the boundaries of the inner and outer surfaces (171, 172)) may be defined by an inner annular edge 606, and an outer annular edge 604 that is concentric with the inner annular edge 606. In other words, the curved body 608 of the reflector 514 may extend between the inner annular edge 606 and an outer annular edge 604. The outer annular edge 604 of the reflector 514 may have a larger diameter than that of the inner annular edge 606.

In certain example embodiments, the outer annular edge 604 may be arranged lower than the inner annular edge 606. However, in other example embodiments, the outer annular edge 604 may be in the same level or higher than the inner annular edge 606. Further, the inner annular edge 606 of the reflector 514 may define a substantially circular central opening 602 that is smaller in diameter than the central aperture 592 of the heat sink 514. That is, the diameter of the inner annular edge 606 of the reflector 514 may be smaller than the diameter of an inner annular edge 610 of the heat sink's planar base portion 590. Furthermore, the diameter of the outer annular edge 604 of the reflector 514 may be larger than the diameter of the inner annular edge 610 of the heat sink's planar base portion 590, but smaller than the diameter of the outer annular edge of the heat sink's planar base portion 590.

In certain example embodiments, the reflector 514 may be coupled to the inner annular edge 610 of the heat sink's planar base portion 590 using one or more tab features 174 or any other appropriate coupling mechanism as described above in association with FIGS. 1-4. In particular, the reflector 514 may be coupled to the heat sink 514 such that: (i) the inner annular edge 606 of the reflector 514 is concentric with, axially aligns with, and remains within the central aperture 592 defined by the inner annular edge 610 of the heat sink's planar base portion 590, and (ii) the curved body 608 of the reflector 514 is disposed below a portion of the LEDs, e.g., an innermost ring/layer of LEDs 510*b* on the circuit board 193 such that the light emitted by the innermost ring/layer of LEDs 510*b* is reflected by the inner surface 171 of the reflector 514 is reflected in a second direction through the central aperture 592 of the heat sink 514 and the central opening 550 of the top surface 549 of the housing 502, providing an uplight. Further, a remaining portion of the LEDs 510*a* fall outside the diameter of the reflector's outer annular edge 604 and are not covered by the reflector 514. Accordingly, light emitted by the remaining portion of LEDs 510*a* exits through the lens 599 in the first direction, providing light downwards or in an area to be illuminated. Thus, via the reflector 514, the light fixture 501 is capable of providing both downlight and uplight without using additional LEDs or changing the configuration of the LEDs.

Turning to FIGS. 7, 8, and 9, these figures illustrate different views of another light fixture assembly in accordance with an example embodiment of the present disclosure. In particular, FIGS. 7-8 illustrate different views of another light fixture assembly with one or more uplight reflectors, in accordance with example embodiments of the present disclosure; and FIG. 9 illustrates the light fixture assembly of FIGS. 7-8 with ray tracing that shows an example reflection of light by the one or more reflectors to provide an uplight, in accordance with example embodiments of the present disclosure.

Referring to FIGS. 7-9, the light fixture assembly 800 may be substantially similar to the previous example light fixture assemblies 100 and 500 of FIGS. 1-6 in that the light fixture assembly 800 of FIGS. 7-9 may include a light fixture 801 and one or more reflectors 804. In particular, the light fixture 801 may include a housing frame 802 that includes a first longitudinal side panel 802*a*, a second longitudinal side panel 802*b* disposed opposite to the first longitudinal side panel 802*a*, a first lateral end plate 802*c* disposed between one end of the first longitudinal side panel 802*a* and a corresponding end of the second longitudinal side panel 802*b*, and a second lateral end plate 802*d* that is disposed opposite to the first end plate 802*c* and between an opposite end of the first longitudinal side panel 802*a* and a corresponding end of the second longitudinal side panel 802*b*. As illustrated in FIGS. 7-9, the pair of longitudinal side panels (802*a,b*) and the pair of lateral end plates (802*c*, 802*d*) are arranged such that they form a substantially rectangular shaped box that defines a cavity 811.

Further, the lighting fixture 801 may include a gear box 815 that is disposed within the cavity 811 and extending between a middle portion of the first longitudinal side panel 802*a* and a middle portion of the second longitudinal side panel 802*b* such that the gear box 815 separates the cavity 811 into two portions. The gear box 815 may be configured to house one or more electronic components associated with the light fixture, e.g., LED drivers, sensors, etc. Furthermore, the light fixture 801 may include two back panels 855, where each back panel 855 is coupled to a top portion 805 of the housing frame 802 and disposed in the respective cavity portions on opposite sides of the gear box 815. Additionally, the light fixture 801 may include: (i) a plurality of light sources, e.g., LEDs 820 that are disposed on their respective circuit boards which are in turn coupled to the back panel 855 such that the light from the LEDs is directed downwards towards an area of illumination, and (ii) one or more pairs of downlight reflector panels 822, each pair disposed adjacent to and on opposite sides of a respective circuit board such that they direct light from the LEDs 820 downwards towards an area of illumination.

As illustrated in FIGS. 7-9, the light fixture assembly 800 may additionally include one or more reflectors 804*a* and 804*b* mounted along each lateral side of the light fixture assembly 800 adjacent the lateral plates 802*c* and 802*d* of the housing frame 802. Similar to the previous reflectors discussed herein in association with FIG. 4, each reflector 804*a*/804*b* may have an inner surface 171 having a concave profile and an outer surface 172 having a convex profile. Further, the inner and outer surfaces of each reflector 804 may be defined by a first curved lateral edge 806, a second curved lateral edge 808 opposite to the first curved lateral edge 806, and a pair of longitudinal edges 814, 816 (also interchangeably referred to as inner edge 816 and outer edge 814). In particular, the reflectors 804*a* and 804*b* may be coupled to the back panel of the light fixture 801 such that: (i) the first longitudinal edge 814 extends outside the perimeter of the housing frame 802, and (ii) a portion of LEDs (outermost row) adjacent the lateral end plates (e.g., outer layer of LEDs) are disposed in between the first lateral edge 806 and the second lateral edge 808 of the respective reflector 804*a*/804*b*, and face the inner concave surface 171 of the respective reflector 804*a*/804*b*. Accordingly, light emitted by the portion of LEDs adjacent the lateral end plates (e.g., outer layer of LEDs) and covered by the reflector 804*a* and/or 804*b* may be reflected by the inner surface 171 of the reflector 804 and redirected in a second direction outside the perimeter of the housing frame 802 which is opposite to the area to be illuminated, thus, providing an uplight, as illustrated in FIG. 9. In other example embodiments, fewer or more reflectors than shown in light fixture assembly 800 may be used. Further, in other example embodiments, the reflectors may be configured to cover and reflect light from more LED layers without departing from a broader scope of the present disclosure.

In certain example embodiments, the reflectors 104, 514, and/or 804 may be fabricated using a reflective material, such as aluminum or highly reflective white plastic. However, in other example embodiments, the reflectors 104, 514, and/or 804 may be fabricated using a non-reflective material and subsequently made to be reflective. For example, the inner surface 171 and/or outer surface 172 of the reflectors 104, 514, and/or 804 may be polished or may be painted to be made reflective so that light emitted from one or more light sources covered by the reflectors 104, 514, and/or 804 and directed towards the inner surface 171 of the reflectors 104, 514, and/or 804 may be reflected and redistributed to another direction, for example, to provide uplight. In certain example embodiments, the inner surface may also be configured to diffuse light in addition to reflecting the light in order to provide a smoother uplight and/or side light. For example, the inner surface 171 may be coated with reflective white paint to provide both the reflector and diffuser properties.

Furthermore, one of ordinary skill in the art can understand and appreciate that the light fixtures illustrated in FIGS. 1-9 are not limiting, and any other light fixture may be used without departing from a broader scope of the present disclosure. For example, the light fixture may be recessed light fixture that is largely disposed through a ceiling. The recessed light fixture may include a housing, a heat sink, and a plurality of LEDs disposed on a circuit board as described above in association with other light fixtures illustrated in FIGS. 1-9. Further, the recessed light fixture may include a flange which biases an underside of the ceiling, keeping the recessed light fixture in position. Furthermore, a reflector having a ring-like shape and a C-shaped or U-shaped cross-sectional profile may encircles a portion of the flange 714 such that a portion of the light emitted from the LEDs is reflected by the reflector onto the ceiling, providing an uplight.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture assembly, comprising:

a light fixture comprising:

a housing that is configured to house one or more electrical components of the light fixture;

a heat sink coupled to the housing, wherein the heat sink comprises:

a planar base portion having an inner annular edge and an outer annular edge that is larger in diameter than and concentric with the inner annular edge, wherein the inner annular edge defines a circular aperture in the center of the planar base portion, and an annular outer plate concentric with the inner annular edge and the outer annular edge of the planar base portion, wherein the annular outer plate has a first diameter that is larger than a second diameter of the outer annular edge of the planar base portion, wherein the first diameter is an outermost diameter of the annular outer plate;

a plurality of LEDs coupled to a surface of the heat sink such that they emit light in a first direction, and one or more reflectors, each having a substantially curved cross-sectional profile, wherein at least one of the one or more reflectors is coupled to the heat sink and disposed in the first direction of at least a portion of the plurality LEDs such that light emitted by the portion of the plurality of LEDs in the first direction is reflected by the at least one of the one or more reflectors towards a second direction that is substantially opposite to the first direction, wherein each of the one or more reflectors have an inner edge and an outer edge, and wherein at least one of the one or more reflectors is coupled to at least one of the outer annular edge of the heat sink and the annular outer plate of the heat sink via one or more tab features of the reflector such that:

the at least one of the one or more reflectors is disposed below the heat sink, the outer edge of the at least one of the one or more reflectors extends outside the first diameter of the annular outer plate of the heat sink, and the portion of the plurality of the LEDs is disposed between the inner edge and the outer edge of the at least one of the one or more reflectors.

2. The light fixture assembly of claim 1, wherein each of the one or more reflectors has a substantially concave shaped inner surface that extends between the inner edge and the outer edge, wherein the substantially concave shaped inner surface reflects the light emitted by the portion of the plurality of LEDs.

3. The light fixture assembly of claim 1, wherein the heat sink further comprises:

a plurality of heat sink fins extending from the annular outer plate towards the inner annular edge and substantially perpendicular to the planar base portion.

4. The light fixture assembly of claim 3, wherein the portion of the plurality of LEDs is disposed on the planar base portion and adjacent the outer annular edge of the planar base portion.

5. The light fixture assembly of claim 1:

wherein the outer edge of the at least one of the one or more reflectors is separated from the annular outer plate of the heat sink by a space, and wherein at least a portion of the light reflected by the at least one of the one or more reflectors in the second direction exits through the space in between the outer edge of the at least one of the one or more reflectors and the annular outer plate of the heat sink.

6. The light fixture assembly of claim 1, wherein the housing has a side wall and a bottom end that define a cylindrical cavity configured to house the one or more electronic components of the light fixture, and wherein the housing is disposed above and coupled to the heat sink via one or more coupling arms such that the bottom end of the housing is axially aligned with the circular aperture of the heat sink.

7. A light fixture comprising:

a housing configured to house one or more electrical components;

a heat sink coupled to the housing, wherein the heat sink comprises:

a planar base having an inner annular edge and an outer annular edge, wherein the inner annular edge defines an aperture in the center of the planar base, and an annular outer plate that is concentric with the inner annular edge and the outer annular edge of the planar base, wherein the annular outer plate has a first diameter that is larger than a second diameter of the outer annular edge of the planar base, wherein the first diameter is an outermost diameter of the annular outer plate;

a plurality of LEDs coupled to the heat sink such that they emit light in a first direction, the light emitted in the first direction configured to create a downward directed light, and a reflector having a substantially curved cross-sectional profile, wherein the reflector is coupled to the heat sink and configured such that a portion of the light emitted by the plurality of LEDs in the first direction is reflected by the reflector towards a second direction that is substantially opposite to the first direction, the portion of the light reflected by the reflector toward the second direction configured to create an upward directed light, and wherein the reflector is coupled to at least one of the outer annular edge of the heat sink and the annular outer plate of the heat sink such that the reflector is disposed in the first direction relative to the heat sink.

8. The light fixture of claim 7, wherein the reflector has an inner edge and an outer edge, and wherein the reflector is coupled to the heat sink such that: the outer edge of the reflector extends outside the outermost diameter of the annular outer plate of the heat sink.

9. The light fixture of claim 7, wherein the reflector has a substantially concave shaped inner surface that extends between an inner edge and an outer edge, wherein the substantially concave shaped inner surface reflects the portion of the light reflected by the reflector.

10. The light fixture of claim 7, wherein the heat sink further comprises:

a plurality of heat sink fins extending from the annular outer plate towards the inner annular edge and substantially perpendicular to the planar base.

11. The light fixture of claim 7, wherein the plurality of LEDs are disposed on the planar base and adjacent the outer annular edge of the planar base.

12. The light fixture of claim 7:

wherein the outer edge of the reflector is separated from the annular outer plate of the heat sink by a space, and wherein at least a portion of the upward directed light exits through the space between the outer edge of the reflector and the annular outer plate of the heat sink.

13. The light fixture of claim 7, wherein the housing has a side wall and a bottom end that define a cylindrical cavity configured to house the one or more electronic components.

14. A light fixture comprising:

a housing that is configured to house one or more electrical components;

a heat sink coupled to the housing, wherein the heat sink comprises:

a planar base having an inner annular edge and an outer annular edge that is larger in diameter than and concentric with the inner annular edge, wherein the inner annular edge defines a central aperture, and an annular outer plate that is concentric with the inner annular edge and the outer annular edge of the planar base;

a light source coupled to the heat sink such that the light source emits light in a first direction, the light emitted in the first direction configured to create a downward directed light, and a reflector having a substantially curved cross-sectional profile, wherein the reflector is coupled to the heat sink and disposed in the first direction relative to the heat sink such that a portion of the light emitted by the light source in the first direction is reflected by the reflector toward a second direction that is substantially opposite to the first direction, the portion of the light reflected by the reflector toward the second direction configured to create an upward directed light.

15. The light fixture of claim 14:

wherein the reflector is coupled to at least one of the outer annular edge of the heat sink and the annular outer plate of the heat sink via one or more tab features.

16. The light fixture of claim 14, wherein the reflector has an inner edge and an outer edge, and wherein the reflector is coupled to the heat sink such that: the outer edge of the reflector extends outside an outer diameter of the annular outer plate of the heat sink.

17. The light fixture of claim 14, wherein the reflector has a substantially concave shaped inner surface that extends between an inner edge and an outer edge, wherein the substantially concave shaped inner surface reflects the portion of the light emitted by the light source.

18. The light fixture of claim 14, wherein the heat sink further comprises:

a plurality of heat sink fins extending from the annular outer plate towards the inner annular edge and substantially perpendicular to the planar base.

19. The light fixture of claim 14, wherein the light source is disposed on the planar base portion and adjacent the outer annular edge of the planar base portion.

20. The light fixture of claim 14:

wherein the outer edge of the at least one of the one or more reflectors is separated from the annular outer plate of the heat sink by a space, and wherein at least a portion of the light reflected by the at least one of the one or more reflectors in the second direction exits through the space in between the outer edge of the at least one of the one or more reflectors and the annular outer plate of the heat sink.

* * * * *